United States Patent [19]

O'Donnell

[11] 4,105,350

[45] Aug. 8, 1978

[54] SAFETY FLEXURE FOR ARTICULATED CHANNEL-SHAPED ROADWAY POSTS

[76] Inventor: John Francis O'Donnell, P.O. Box 3314 Glenn Ave. Stations, Peoria, Ill. 61614

[21] Appl. No.: 769,731

[22] Filed: Feb. 17, 1977

[51] Int. Cl.[2] ..... E01F 9/01

[52] U.S. Cl. ..... 403/220; 40/608; 404/10; 52/98; 248/22; 403/294

[58] Field of Search ..... 403/220, 225, 228, 291, 403/287, 223, 2, 294; 40/145 A, 145 R; 256/1, 13.1; 404/9, 10; 64/27 NM, 11 R; 52/98, 110, 116, 290; 248/160, 24, 22, 358 R

[56] References Cited

U.S. PATENT DOCUMENTS

| | | | |
|---|---|---|---|
| 2,357,893 | 9/1944 | Harrington | 403/220 X |
| 2,969,656 | 1/1961 | Reuter | 403/223 X |
| 3,250,032 | 5/1966 | Von Gal, Jr. | 40/145 R |
| 3,355,998 | 12/1967 | Roemisch | 403/2 |
| 3,438,311 | 4/1969 | Remek | 404/10 |

FOREIGN PATENT DOCUMENTS

| | | | |
|---|---|---|---|
| 584,312 | 1/1947 | United Kingdom | 403/220 |

*Primary Examiner*—Andrew V. Kundrat
*Attorney, Agent, or Firm*—David H. Hill

[57] ABSTRACT

A safety flexure for articulated channel-type roadway posts wherein a resilient member interconnects the upper and lower portions of the post by means of connecting studs substantially complementary in size and shape with the channel portions thereof.

16 Claims, 6 Drawing Figures

16
18
20
22
24
26
28
30
32
34
36
38
40
42
44
46
48
50
D

SAFETY FLEXURE FOR ARTICULATED CHANNEL-SHAPED ROADWAY POSTS

FIELD OF THE INVENTION

This invention pertains generally to roadway markers, and more particularly to roadside posts adapted to define a right-of-way which includes the road itself, the shoulders therefor and an appropriate additional width of adjacent land on either or both sides thereof. More specifically, the invention pertains to a flexure means for articulated roadway posts for permitting pivotal movement of an upper portion thereof relative to a stationary lower portion thereof to prevent damage to the roadway post when struck by a passing vehicle.

BACKGROUND OF THE INVENTION

Roadside or right-of-way markers are quite common on today's highways, particularly at locations at which the driver is called upon to execute a turn, such as at a bend in the road or, and perhaps more importantly, at exit ramps or the like from high-speed highways, where the driver not only executes a relatively sharp turn but is also required to decrease the speed of the vehicle and prepare for merging with traffic on the crossroad to which the exit leads.

Such roadway markers commonly comprise a rigid upright post of a substantially U-shaped central cross-section with wing-like side portions, with the bottom portion being driven into the ground for support, and with a suitable reflector mounted on the upper portion facing the oncoming traffic to be directed thereby. Such reflectors are commonly given a suitable color, such as amber, not only for reflecting the light from the headlights of approaching vehicles at night, but also to render the posts more visible in daylight. In the more common version of these roadway posts, the center section of the substantially U-shaped channel portion includes a plurality of holes therein spaced along the length of the post, and one or more of these holes serve as a means for mounting one or more reflectors on such posts.

Roadway posts of this type, used primarily to delineate the outer limits of a right-of-way at a bend or turn therein, are commonly positioned in the earth at the side of a roadway, usually at a distance of a few feet or a few yards beyond the shoulder of the roadway. Yet, in spite of this distance away from the usual path of vehicular traffic, such roadway posts are often subjected to impact by passing vehicles which leave the road and cross over the shoulders thereof as a result, for example, of a skid on wet or icy pavement, or due to a sudden turn to avoid a collision, or, and perhaps more commonly, as a result of improper control due to sleepiness or intoxication on the part of the driver. It is a common sight along today's highways to see tire skid marks leading to a plurality of bent, mangled and destroyed roadway posts. The costs of repair and replacement of such posts, both for materials and labor, have risen to an alarming level.

SUMMARY OF THE INVENTION

The device of the present invention, while normally maintaining the roadway post in an upright position, permits pivotal movement of the upper portion of such post relative to the stationary lower portion thereof upon impact by a vehicle, and then returns the upper portion of the post to the vertical position after passage of the vehicle. By virtue of this ability to bend with impact, the post survives the collision with little or no damage and remains in place in a functional condition, obviating repair or replacement. The post thus remains in service even after impact, avoiding the "downtime" preceding repair or replacement of the posts of the prior art, and effects significant monetary savings as a result of the relative lack of maintenance. Further, the flexing of the post upon impact constitutes a safety feature, since the post does not offer significant resistance to the vehicle. In addition, damage to the vehicle is avoided as a result of this lack of resistance.

The flexible means embodying the present invention is inserted between upper and lower portions of a vertical channel-type roadway post, the post having been cut in two if necessary to provide such separate portions, and is connected to the two post portions by means of connecting studs substantially complementary in size and shape with the channel portions of the post.

BRIEF DESCRIPTION OF THE DRAWINGS

The invention itself will now be described in connection with a preferred embodiment thereof, given by way of example, and not of limitation, in connection with the accompanying drawings, in which.

DESCRIPTION OF THE INVENTION

Figures 1, 6:
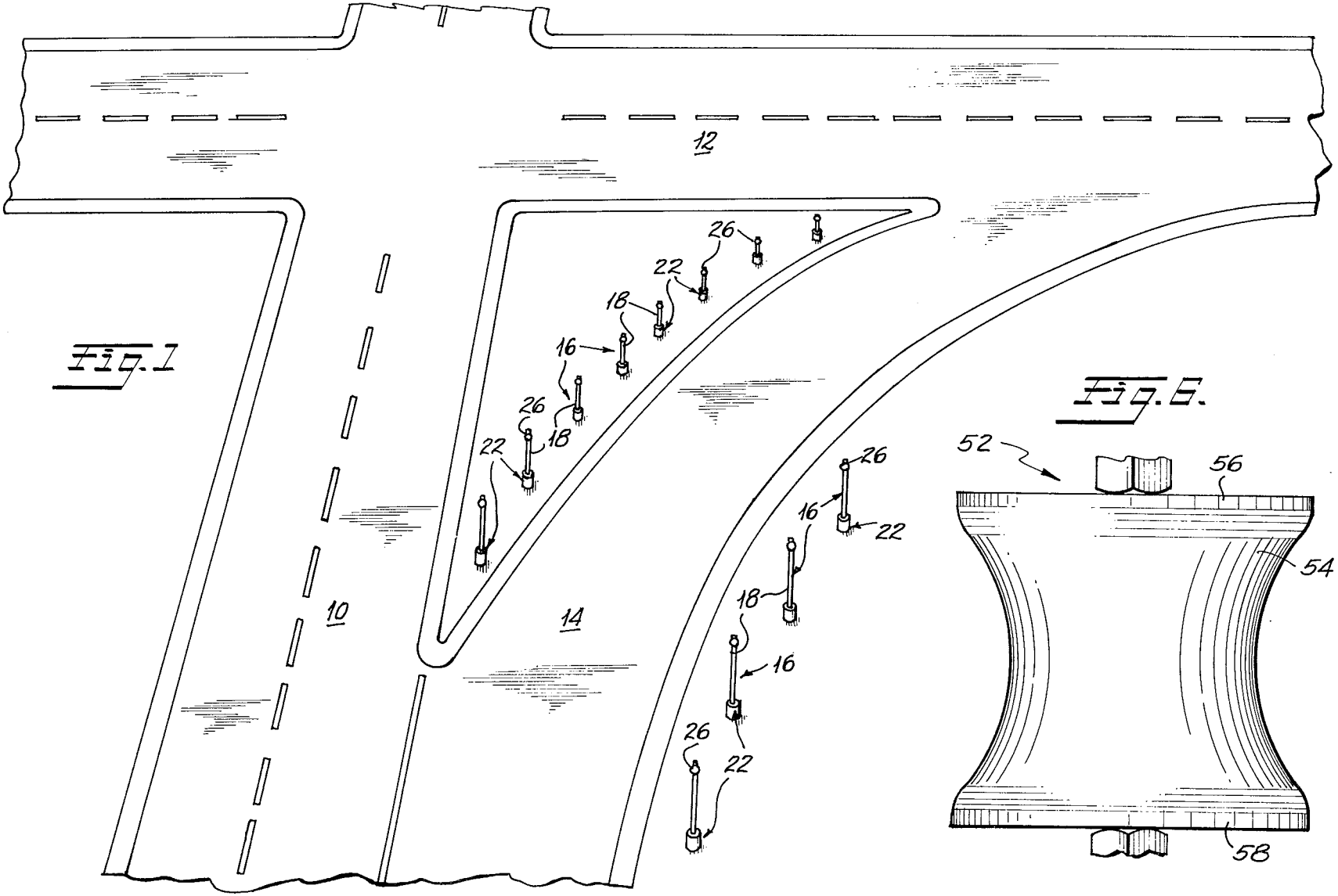
FIG. 1 is a perspective view of a typical roadway scene showing one manner of utilization of the device of the present invention.
FIG. 6 is an elevation view of a second embodiment of the flexure means of the present invention.

FIG. 1 shows in perspective a typical roadway scene including a first road 10, a second road 12 and a exit ramp 14 leading from the former to the latter. As vehicles proceed down the exit ramp 14 from roadway 10 toward roadway 12, there is a need for guiding the vehicles, especially at night, in negotiating the turn included in the exit ramp 14. As is the common practice in connection with modern highways of this type, the left-hand side of the ramp 14 is lined with a plurality of roadway posts 16 having suitable reflectors thereon for reflecting the headlight beams from a vehicle descending the ramp 14. These roadway posts 16 are usually spaced along the roadway at equal distances, and are commonly set back from the road a suitable distance beyond the shoulder of the road, both to provide room for emergency parking and to reduce the chance of being struck by passing vehicles. The posts 16 on the left side of the exit ramp 14 normally follow the turn a greater distance than the posts 16 on the right side of the exit ramp, since those on the left-hand side of the road are the ones which will be seen in the beams of the headlights of a car traversing exit ramp 14.

Figures 2, 3, 4, 5:
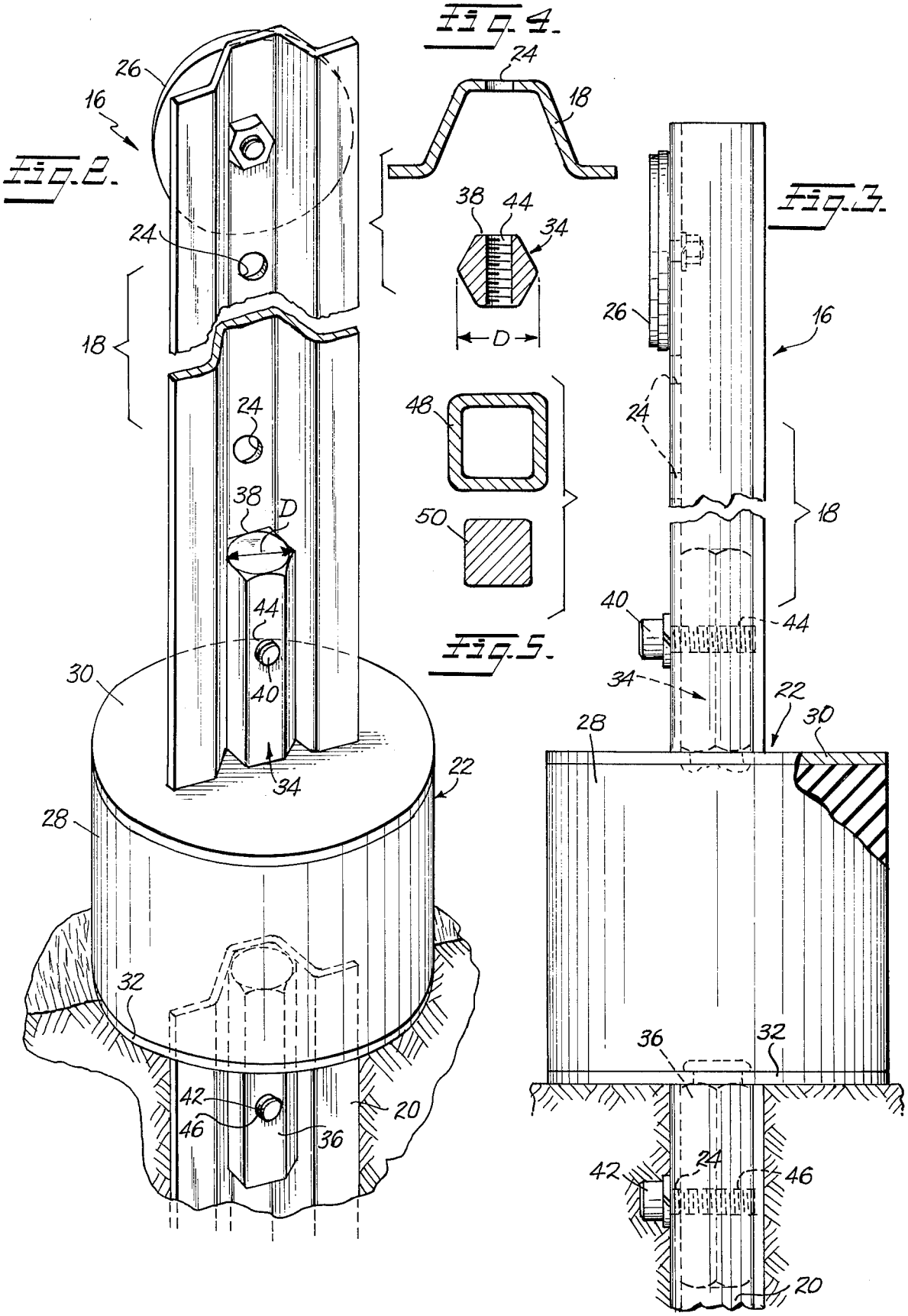
FIG. 2 is a perspective view of the device of the present invention shown in place between the upper and lower portions of a channel-type roadway post.
FIG. 3 is an elevation view, partly in section, of the apparatus shown in FIG. 2.
FIG. 4 is a cross-sectional view, generally, of the channel-type post and the connecting studs of FIG. 3.
FIG. 5 is a sectional view similar to that of FIG. 4 but of a different embodiment of the invention wherein the channel-type post is a closed channel and the connecting stud is complementary in size and shape.

FIG. 2 shows in greater detail the structure of the roadway post 16, as well as the structure of a preferred embodiment of the flexure device of the present invention. Roadway post 16 consists of an upper portion 18 and a lower portion 20, the two portions being articulated as shown in FIG. 2 by means of the interconnecting flexure means 22 of the present invention.

Roadway posts of this type are quite common, with many thousands of such posts presently in use along the highways. Normally, the roadway post 16 consists of one integral channel-shaped member of some six or seven feet in length. The configuration of the cross section of the post 16 is generally that of a central U-shaped channel positioned between two wing-like extremities at the edges of the post, with the U-shaped channel having a substantially planar center section with a plurality of holes 24 therein usually equally spaced along the entire length of the post.

In the prior-art use of posts of this type, the post is usually driven into the ground at a suitable location and to the extent that perhaps a third of the post is below ground, with the remainder standing upright and usually carrying a reflector 26. However, with a unitary or integral post of this type, impact by a passing vehicle will bend the post or even snap it in two, since there is not sufficient flexibility in the post to permit a bending and a return to the vertical position.

In accordance with the present invention, the post is cut into two sections, preferably a four foot upper section and the remainder as the lower section, and the flexure means 22 of the present invention then interconnects the two pieces of the post to provide a flexible articulation of the post pieces. By this construction, and with the base of the flexure means 22 preferably at ground level, the upper section 18 of the post 16 may be struck by a moving vehicle or the like and pivoted even to a horizontal position to permit the vehicle to pass thereover. After the impact, the flexure member 22 returns to its original shape, returning the upper post portion 18 to the normal upright position.

Referring more particularly to the structure of the flexure member 22, the main body 28 thereof consists, in this preferred embodiment, of a solid, substantially cylindrical body of rubber. An upper disc-like end cap 30 of a suitably rigid metal is firmly secured to the upper face of the solid rubber cylinder 28, preferably by being bonded thereto. Similarly, a lower metallic disc-like end cap 32 is firmly bonded to the lower planar face of the solid rubber cylinder member 28.

Referring to FIGS. 2 and 3 together, a first elongate rigid stud member 34 is fixedly attached to the upper face of the upper end cap 30, the stud 34 being positioned centrally of the end cap 30 and perpendicular thereto. The means of attachment of the stud member 34 to the end cap 30 may comprise, for example, the staking of an end portion of the stud 34 extending through a central aperture in the end cap 30, such staking being at least schematically indicated in dotted lines in FIG. 3. In a similar manner, a second elongate rigid stud member 36 is fixedly attached to the lower disc-like end cap 32, being positioned centrally thereof and extending downwardly perpendicular thereto.

Each of the stud members 34 and 36 has a cross-sectional configuration which is substantially complementary in size and shape with respect to the central portion of the U-shaped channel in the post 16. More particularly, and in the preferred embodiment shown in FIGS. 2, 3 and 4, the cross section of studs 34 and 36 is a hexagon of such size as to fit within the U-shaped channel of the post 16, with the greater diameter D (FIG. 2) of the hexagon substantially bridging the U-shaped channel, and with face 38 (one of the two faces of the hexagon remote from the greater diameter D) of hexagonal stud 34 in contact with and substantially covering the planar center section of the U-shaped channel, such planar center section including the holes 24. The terminology "greater diameter" of the hexagon is intended to refer to the "diameter" between opposed apexes of the hexagon, in contrast to the shorter "diameter" between opposed faces; further, once a given "greater diameter" of the hexagon is selected, there are but two faces of the hexagon which are remote from such "greater diameter," viz., the two faces which do not form a part of either of the two opposed apexes of the chosen "greater diameter." The size and shape of stud 36 is substantially identical with that of stud 34, and the relationship between stud 36 and lower post portion 20 is correspondingly similar to that between stud 34 and the upper post portion 18.

The interfitting of studs 34 and 36 with the respective post portions 18 and 20 is such that when the stud members are in position within the respective channel members, there can be little or no relative movement between each stud and the associated post portion, since the stud substantially fills the adjacent channel. In order to retain each stud within the respective channel, suitable threaded connectors 40 and 42 are passed through holes 24 in the post portion and secured to the stud members. That is to say, a threaded connector 40 may be passed through one of the holes 24 in upper post portion 18 and be threadedly engaged within a threaded hole 44 in stud member 34. Similarly, threaded connector 42 may be passed through a hole 24 in lower post portion 20 and then be threadedly engaged with a threaded aperture 46 in stud 36. Obviously, the respective connections may be made in any other suitable manner, such as by passing the threaded connectors through unthreaded holes in both the post portions and the corresponding stud members, with a suitable nut being threaded onto the exposed end of the connector as it protrudes from the hole in the stud member.

FIG. 4 shows a representative cross section of the channel post member 18 and the stud member 34 of the preferred embodiment shown in FIGS. 2 and 3. FIG. 5 shows a corresponding representative cross section of a second embodiment, wherein the longitudinal channel of the roadway post is closed along its length, in contrast to the channel of the post of the previous figures which is open to one side. The post member 48 is, in the embodiment of FIG. 5, a box beam, rather than a U-shaped channel, and the corresponding stud member 50 to be used therewith is substantially square in cross section. Obviously, other mutually complementary configurations, such as circular, might be used.

FIG. 6 shows a second embodiment of the flexure member of the present invention, this flexure member 52 including a solid rubber member 54 of substantially cylindrical shape, with the diameter of the mid portion thereof being less than the diameter at either end thereof at end caps 56 and 58. This "hourglass" configuration of the flexing member offers less resistance to the pivoting movement of the upper portion of the roadway post when struck by a vehicle, and may, accordingly, be desirable in certain applications.

The invention has been described above in some detail, with particular reference to its application to the field of reflective roadway markers and the like. However, it will be obvious to those skilled in the art that the flexure apparatus of the present invention will find utility in other analogous roadway applications, and, further, that variations in the structural details described above may be made within the teaching of the invention. For example, the upper section of the roadway post may be utilized to support means other than a reflector. Hence, the invention is not to be considered as being limited to the particular details given, nor to the specific application to which reference has been made during the description of the apparatus, except insofar as may be required by the scope of the appended claims.

What is claimed is:

1. A safety flexure for an articulated roadway post of the type having a cross-sectional configuration including a substantially U-shaped channel portion, comprising a substantially cylindrical member of resilient material, first and second metallic disc-like end caps securely bonded, respectively, to the opposite end faces of said cylindrical resilient member, and first and second elongate rigid stud members fixedly attached, respectively, to said first and second end caps centrally thereof and perpendicular thereto, at least a portion of each of said elongate stud members being substantially complementary in size and shape with the channel portion of such articulated roadway post and being adapted to be securely but removably attached thereto, whereby upper and lower portions of such an articulated channel-shaped roadway post may be resiliently interconnected by attachment to respective ones of said first and second stud members.

2. A safety flexure for an articulated roadway post in accordance with claim 1, wherein said substantially cylindrical member is solid.

3. A safety flexure for an articulated roadway post in accordance with claim 1, wherein said substantially cylindrical member is composed of rubber.

4. A safety flexure for an articulated roadway post in accordance with claim 1, wherein the diameter of said substantially cylindrical member is constant from one end thereof to the other.

5. A safety flexure for an articulated roadway post in accordance with claim 1, wherein the diameter of one end of said substantially cylindrical member is equal to that of the opposite end thereof, and the diameter of the mid-portion thereof is different therefrom.

6. A safety flexure for an articulated roadway post in accordance with claim 5, wherein the diameter of the mid-portion of said substantially cylindrical member is less than that at either end thereof.

7. A safety flexure for an articulated roadway post in accordance with claim 1, wherein the opposite end faces of said substantially cylindrical member are planar.

8. A safety flexure for an articulated roadway post in accordance with claim 1, wherein said first and second disc-like end caps are planar.

9. A safety flexure for an articulated roadway post in accordance with claim 1, wherein the opposite end faces of said substantially cylindrical member are planar, and the surface of each of said first and second disc-like end caps adjacent a respective end of said substantially cylindrical member is planar.

10. A safety flexure for an articulated roadway post in accordance with claim 1, wherein each of said first and second stud members is mechanically staked to a respective one of said first and second end caps.

11. A safety flexure for an articulated roadway post in accordance with claim 1, wherein said complementary portion of each of said first and second elongate rigid stud members includes at least one hole therein transverse the length thereof for alignment with a respective one of the plurality of holes normally spaced along the length of the center section of the substantially U-shaped channel portion of such roadway posts, and including a threaded connector means adapted to be positioned in said hole in each of said stud members and in a respective aligned hole of such roadway post for removably attaching each of said stud members to a respective portion of such an articulated post.

12. A safety flexure for an articulated roadway post of the type having a cross-sectional configuration including a substantially U-shaped channel portion the inner face of the center section of which is substantially planar, comprising:

a substantially cylindrical member of resilient material, first and second metallic disc-like end caps securely bonded, respectively, to the opposite end faces of said cylindrical resilient member, and first and second elongate rigid stud members fixedly attached, respectively, to said first and second end caps centrally thereof and perpendicular thereto, at least a portion of each of said elongate stud members being substantially complementary in size and shape with the channel portion of such articulated roadway post and being adapted to be securely but removably attached thereto, the cross-sectional configuration of said complementary portion of each of said stud members being hexagonal, with one of the three greater diameters of such hexagonal cross-section substantially bridging such substantially U-shaped channel portion when one of the remote faces of such hexagonal cross-section is adjacent such substantially planar inner face of the center section of such channel portion, whereby upper and lower portions of such an articulated channel-shaped roadway post may be resiliently interconnected by attachment to respective ones of said first and second stud members.

13. A safety flexure for an articulated elongate roadway post of the type having a longitudinal channel therein, comprising a substantially cylindrical member of resilient material, first and second metallic disc-like end caps securely bonded, respectively, to the opposite end faces of said cylindrical resilient member, and first and second elongate rigid stud members fixedly attached, respectively, to said first and second end caps centrally thereof and perpendicular thereto, at least a portion of each of said elongate stud members being substantially complementary in size and shape with the channel portion of such articulated roadway post and being adapted to be securely but removably attached thereto, whereby upper and lower portions of such an articulated elongate roadway post may be resiliently interconnected by attachment to respective ones of said first and second stud members.

14. A safety flexure for an articulated elongate roadway post in accordance with claim 13, wherein such longitudinal channel is open to one side of such elongated roadway post.

15. In combination, an articulated roadway post and safety flexure therefor, comprising:

upper and lower roadway post portions of the type having a cross-sectional configuration including a substantially U-shaped channel portion, a substantially cylindrical member of resilient material, first and second metallic disc-like end caps securely bonded, respectively, to the opposite end faces of said cylindrical resilient member, and first and second elongate rigid stud members fixedly attached, respectively, to said first and second end caps centrally thereof and perpendicular thereto, at least a portion of said first stud member being substantially complementary in size and shape with the channel portion of the bottom end of said upper post portion and being securely but removably attached thereto with said bottom end of said upper post portion being adjacent the upper face of said first end cap, at least a portion of said second stud member being substantially complementary in size and shape with the channel portion of the top end of said lower post portion and being securely but removably attached thereto with said top end of said lower post portion being adjacent the lower face to said second end cap, said upper and lower post portions thus being spaced apart longitudinally a distance at least equal to the actual dimension of said cylindrical resilient member.

16. In combination, an articulated roadway post and safety flexure therefor, comprising:

upper and lower roadway post portions of the type having a longitudinal channel therein, a substantially cylindrical member of resilient material, first and second metallic disc-like end caps securely bonded, respectively, to the opposite end faces to said cylindrical resilient member, and first and second elongate rigid stud members fixedly attached, respectively, to said first and second end caps centrally thereof and perpendicular thereto, at least a portion of said first stud member being substantially complementary in size and shape with the channel portion of the bottom end of said upper post portion and being securely but removably attached thereto with said bottom end of said upper post portion being adjacent the upper face of said first end cap, at least a portion of said second stud member being substantially complementary in size and shape with the channel portion of the top end of said lower post portion and being securely but removably attached thereto with said top end of said lower post portion being adjacent the lower face of said second end cap, said upper and lower post portions thus being spaced apart longitudinally a distance at least equal to the actual dimension of said cylindrical resilient member.

* * * * *